US011896050B2

(12) United States Patent
Wang

(10) Patent No.: US 11,896,050 B2
(45) Date of Patent: Feb. 13, 2024

(54) CONTAINER ASSEMBLY

(71) Applicant: Charlie Wang, Chino, CA (US)

(72) Inventor: Charlie Wang, Chino, CA (US)

( * ) Notice: Subject to any disclaimer, the term of this patent is extended or adjusted under 35 U.S.C. 154(b) by 286 days.

(21) Appl. No.: 17/378,326

(22) Filed: Jul. 16, 2021

(65) Prior Publication Data

US 2022/0095675 A1 Mar. 31, 2022

Related U.S. Application Data

(60) Provisional application No. 63/084,118, filed on Sep. 28, 2020.

(51) Int. Cl.
*A24F 1/30* (2006.01)

(52) U.S. Cl.
CPC ..... *A24F 1/30* (2013.01)

(58) Field of Classification Search
CPC ..... A24F 1/30
See application file for complete search history.

(56) References Cited

U.S. PATENT DOCUMENTS

| | | | | |
|---|---|---|---|---|
| 4,111,213 | A * | 9/1978 | Shanto | A24F 1/30 131/210 |
| 7,404,405 | B1 * | 7/2008 | Mehio | A24F 1/30 131/191 |
| D622,502 | S * | 8/2010 | Badawi | D3/276 |
| 2013/0146074 | A1 * | 6/2013 | Virga | A24F 1/24 131/226 |
| 2019/0230981 | A1 * | 8/2019 | Isler | A24F 1/02 |

FOREIGN PATENT DOCUMENTS

| | | | | |
|---|---|---|---|---|
| EP | 3808193 | A1 * | 4/2021 | A24F 1/30 |

* cited by examiner

*Primary Examiner* — Dennis R Cordray
(74) *Attorney, Agent, or Firm* — Adibi IP Group, PC; Amir V. Adibi; Andrew C. Palmer

(57) ABSTRACT

A container assembly and method is provided for concealing and storing a water bong. The container assembly, for example, is generally a cylindrical container comprising a upper container, a upper container lid, a lower container, a percolator, a inlet port, a neck, and a bowl, wherein the neck and the bowl are configured to be stored in the lower container. The container assembly and method also involves sliding the percolator to and from an extracted position that permits a smoker to inhale combustible substances, to a concealed position within the upper container.

20 Claims, 10 Drawing Sheets

CONTAINER ASSEMBLY

CROSS-REFERENCE TO RELATED APPLICATIONS

The present application claims priority to U.S. Provisional Patent Application No. 63/084,118, filed on Sep. 28, 2020, and entitled, "Container Assembly," the entire disclosure of which is incorporated by reference herein.

BACKGROUND OF THE INVENTION

1. Field of Invention

The present invention relates generally to an apparatus to store a smoking water pipe or bong. More specifically, the present invention relates to a container assembly having a disguised appearance that permits a smoker to inhale combustible substances such as tobacco and medicinal herbs.

2. Description of Related Art

The use of water in a smoking apparatus is ancient, dating back at least several hundred years. Illustrative examples of early smoking water pipes are Persian hookahs or, wherein smoke from the substance being combusted is directed through a tube discharging below the surface of water in a chamber before passing therefrom through a second tube to the mouth of the smoker. More recently, various modern versions of the water pipes have been manufactured, sold and used. These versions have not differed in the basic respect from the original hookah, comprising principally a chamber for holding, the water, a bowl for the combustible substance communicating by a hollow tube to a point beneath the water, and an outlet tube from a smoke chamber formed above the surface of the water to the mouth of the smoker. These modern versions of the hookah have been produced in forms not adaptable to being carried by the smoker in a more compact, smaller, and portable version. Furthermore, the size and shape of these modern versions lack a disguised appearance and draws attention to the user when traveling with a water pipe in pubic. Since many users prefer to not draw attention to themselves, a desire exists for a container to disguise and store a smoking water pipe or bong in a portable container assembly.

SUMMARY OF THE INVENTION

Prior to embodiments of the disclosed invention, there was no way to contain a water pipe in a discrete container assembly. Embodiments of the disclosed invention solve this problem and overcomes the deficiencies of the prior art.

According to one embodiment, a container assembly configured to store a water bong; the container assembly comprising: a upper container, the upper container further comprising a inner cylinder wall, a outer cylinder wall, a upper edge, a lower edge, a upper container rim arranged at the upper edge of the upper container, and a inlet port, wherein the inlet port extends through the outer cylinder wall and inner cylinder wall and into the upper container; a upper container lid, wherein the upper container lid is detachably coupled to the upper edge of the upper container; a lower container, wherein the lower container is detachably coupled to the lower edge of the upper container; a percolator, the percolator further comprising a gasket and a mouth piece; a neck, wherein the neck is detachably coupled to the inlet port and in fluid communication with the percolator through the inlet port, wherein the neck is configured to be stored in the lower container; and a bowl, wherein the bowl is detachably coupled to the neck and in fluid communication with the neck and the percolator, wherein the bowl is configured to be stored in the lower container.

The present invention provides a compact and portable container assembly to conceal a water bong or pipe that can be quickly assembled and disassembled.

According to another embodiment, a method for concealing a water bong in a container assembly, comprising; attaching a upper container lid to a mouth piece arranged at a upper portion of a percolator, applying pressure to the upper container lid to slide the percolator from a extracted position to a concealed position, wherein the percolator is concealed within the upper container, attaching the upper container lid to the upper edge of the upper container, removing a lower container from the upper container, disconnecting a bowl from a neck, placing the bowl in the lower container, disconnecting the neck from a inlet port of the upper container, placing the neck in the lower container, and attaching the lower container to a lower edge of the upper container.

For various example embodiments, the following is applicable: an apparatus comprising means for performing a method of any of the claims.

Aspects of the present invention relate to an apparatus or device for a container assembly configured to store a water bong or pipe and various accessories for using the water bong or pipe and methods of using the container assembly.

These and other systems, methods, objects, features, and advantages of the present invention will be apparent to those skilled in the art from the following detailed description of the preferred embodiment and the drawings. All documents mentioned herein are hereby incorporated in their entirety by reference.

The foregoing, and other features and advantages of the invention, will be apparent from the following, more particularized description of the preferred embodiments of the invention, the accompanying drawings, and the claims.

BRIEF DESCRIPTION OF THE DRAWINGS

The detailed description of some embodiments of the invention is made below with reference to the accompanying figures.

DETAILED DESCRIPTION OF PREFERRED EMBODIMENTS

Figure 1:
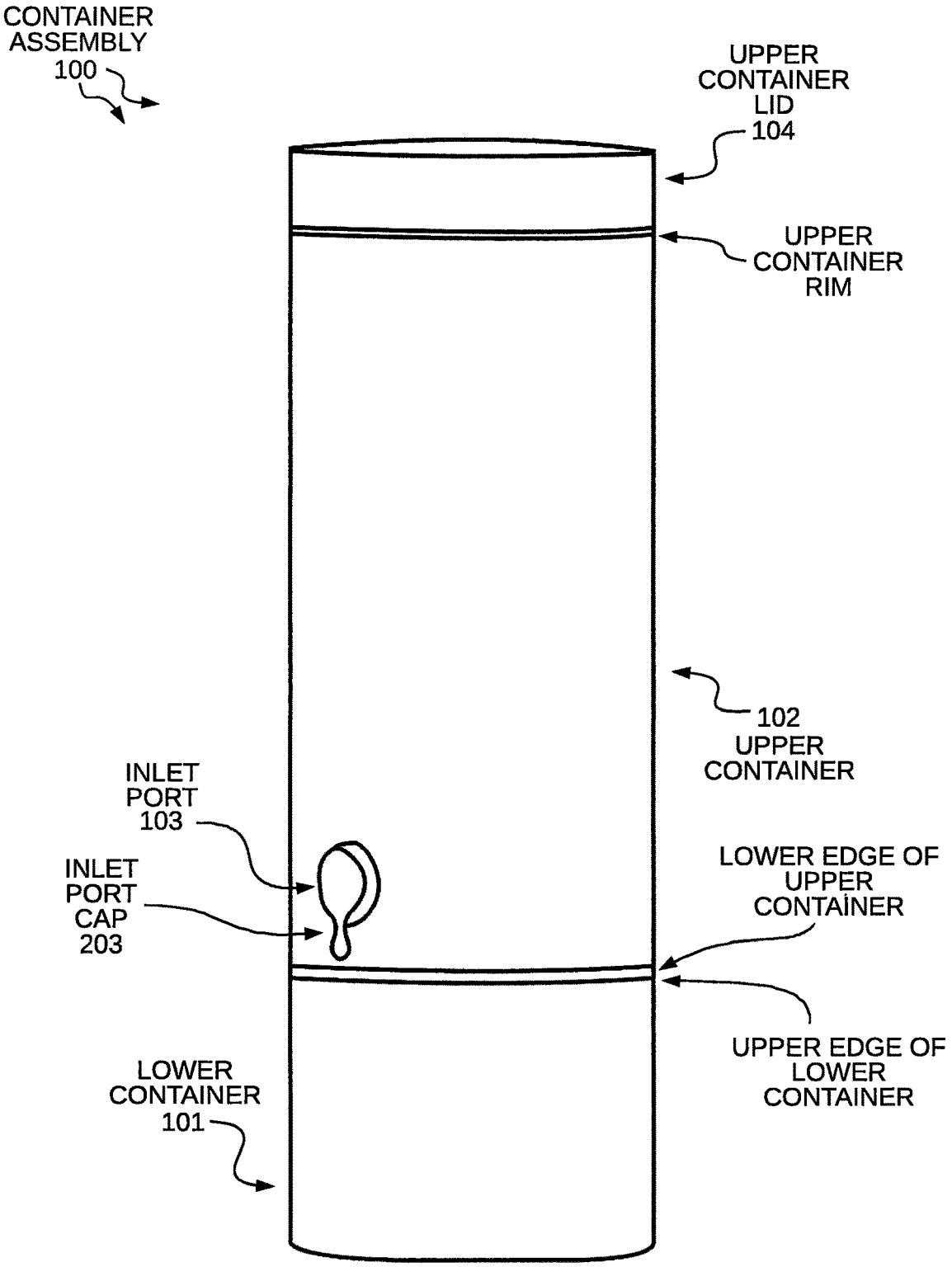
FIG. 1 illustrates a perspective view of the container assembly configured to store a water bong according to one embodiment of the invention.

Preferred embodiments of the present invention and their advantages may be understood by referring to FIGS. 1-10, wherein like reference numerals refer to like elements.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Moreover, the described features, structures, dimensions, or characteristics of the invention may be combined in any suitable manner in one or more embodiments. It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents. Reference will now be made in detail to the preferred embodiments of the invention.

The current invention is a container assembly 100 designed with an innovative approach to conceal a water bong or pipe. This container assembly 100 has a general cylindrical shape to disguise a water bong or pipe. The container assembly 100 can be designed from a variety of materials, to include steel, aluminum, copper, titanium, or plastic. The upper container 102 and lower container 101 can be colored the same or have different colors. The container assembly 100 allows for quick concealment of the water bong or pipe when a user wishes to not draw attention to themselves. The components of the water bong concealed within the container assembly 100 can also be easily disassembled to allow for cleaning of the components of the water bong.

FIG. 1 shows a perspective view of the container assembly 100. The container assembly 100 is comprised of a inner cylinder wall, a outer cylinder wall, a upper container 102, a upper container lid 104, inlet port 103 (displayed with a inlet port cap 203 attached to the inlet port 103), and a lower container 101, wherein the upper container 102 and the lower container 101 are detachably coupled to each other and capable of being segregated from each other. By way of example, one embodiment of the container assembly 100 is configured to store a water bong or pipe and permits the user to quickly assemble or disassemble the water bong concealed within the upper container 102 and the lower container 101. A upper container rim is arranged at an upper edge of the upper container 102. A lower container 101 is detachably coupled to a lower edge of the upper container 102.

The material of container assembly 100 is one selected from a group including but not limited to: steel, aluminum, copper, titanium, plastic, or a combination thereof. The preferred material is aluminum because it is the most cost efficient and is easy to clean and offers protection to the components of the water bong and water bong accessories.

Figure 2:
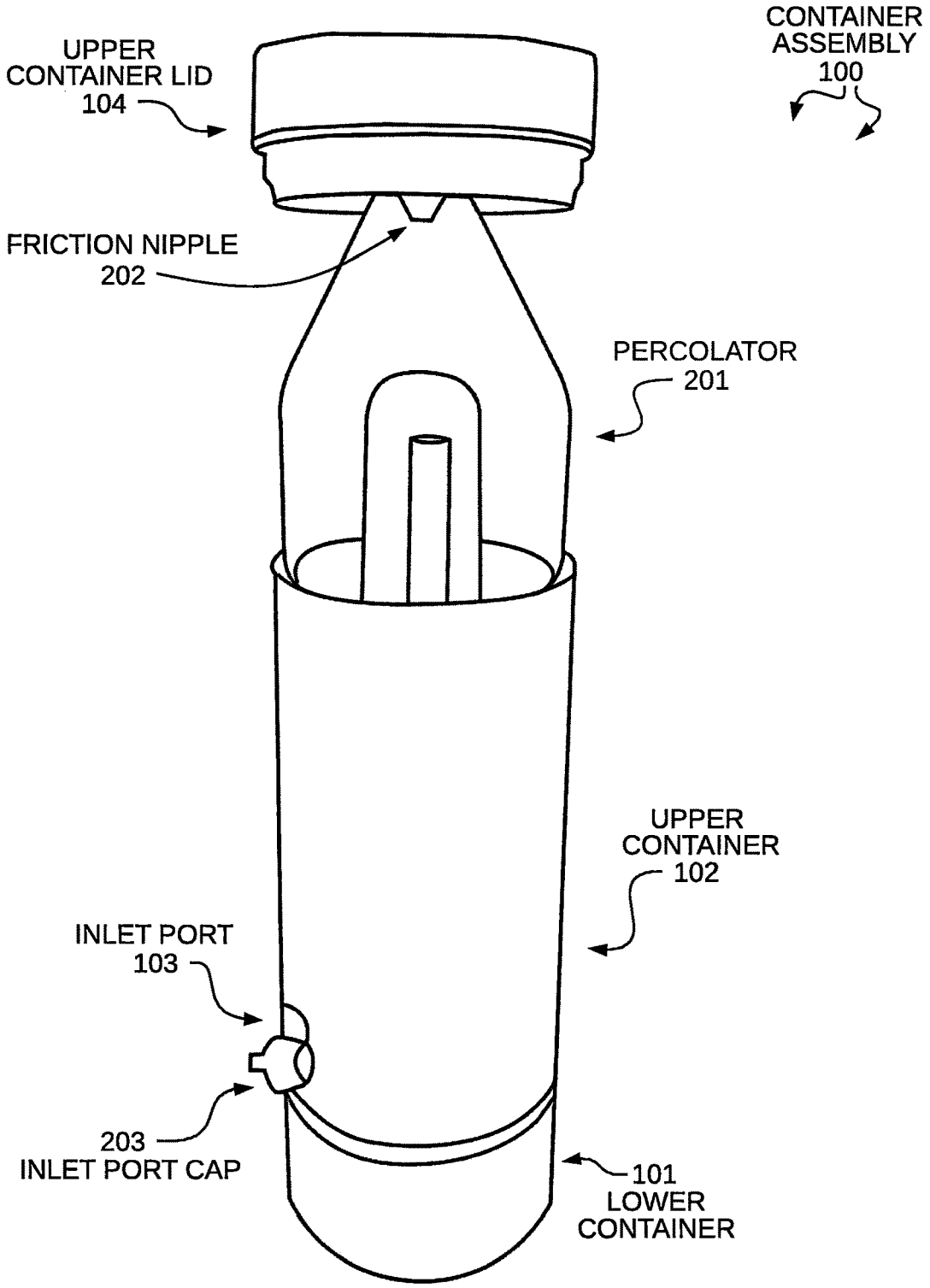
FIG. 2 illustrates a perspective view of the container assembly configured to store a water bong according to one embodiment of the invention.
Figure 3:
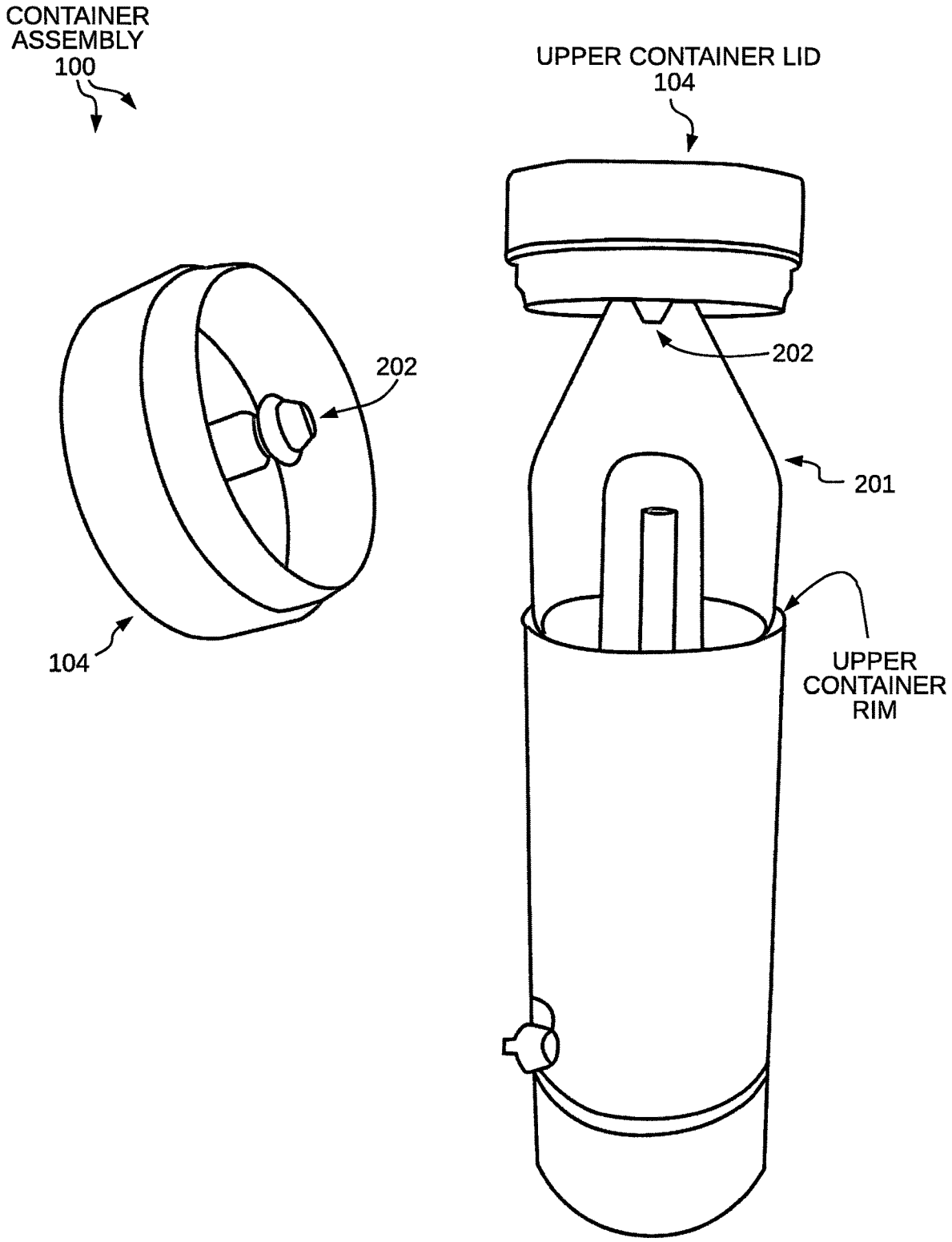
FIG. 3 illustrates a perspective view of the container assembly configured to store a water bong according to one embodiment of the invention.

FIGS. 2 and 3 show a perspective view of the upper container lid 104 and percolator 201. The upper container lid 104 is detachable coupled to the upper edge of the upper container 102 when the percolator 201 is completely inserted into the upper container. This position permits the percolator 201 to be concealed within the upper container 102. In another embodiment, the upper container lid 104 comprises a friction nipple 202 that when inserted into the percolator 201 (as displayed in FIG. 2), allows the percolator 201 to be extracted from its concealed position within the upper container 102. Once the percolator 201 is fully extracted (as displayed in FIG. 2), the percolator 201 is in a position that permits a smoker to inhale combustible substances, such as tobacco and medicinal herbs, through the percolator 201.

Figure 4:
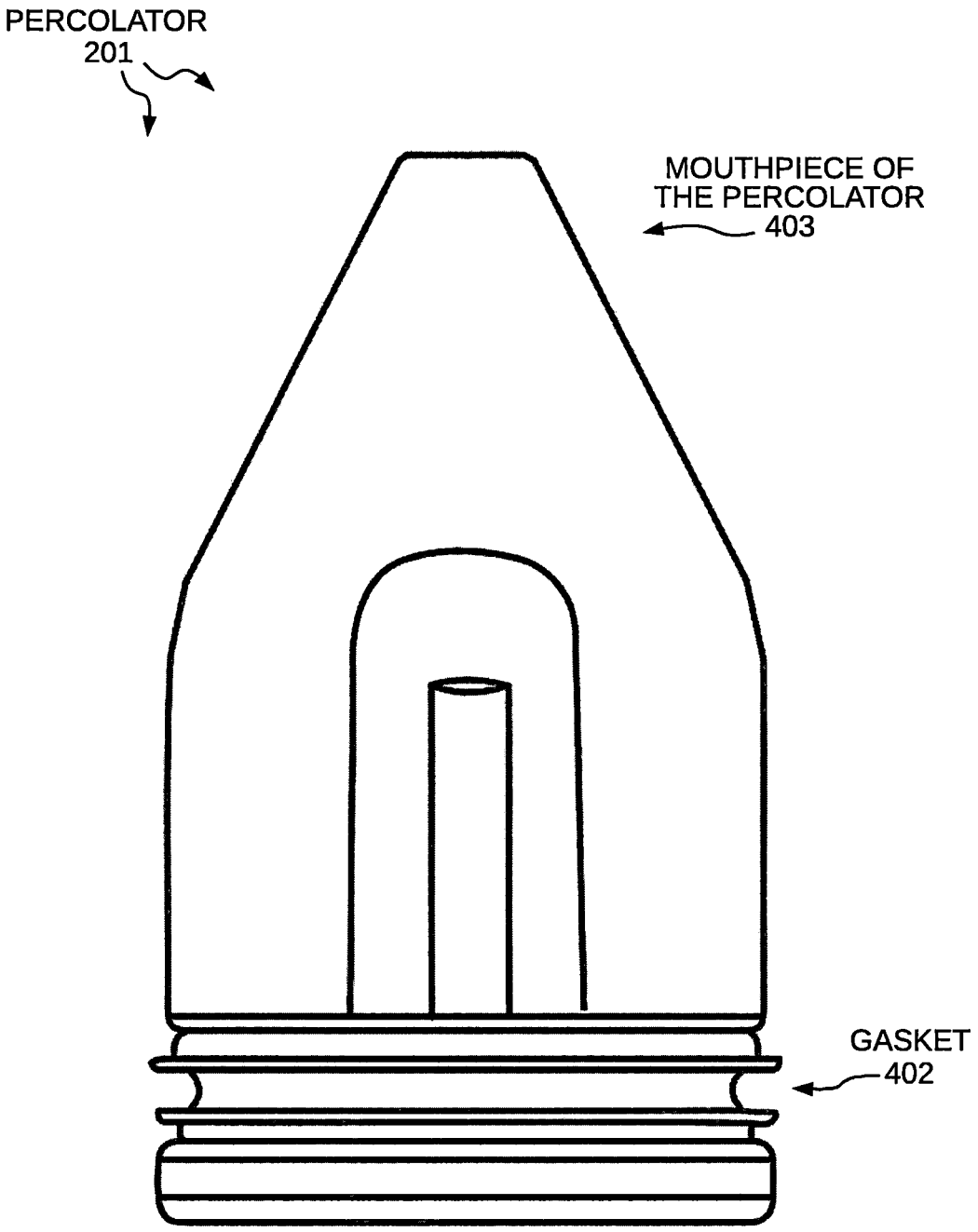
FIG. 4 illustrates a perspective view of the percolator according to one embodiment of the invention.
Figure 5:
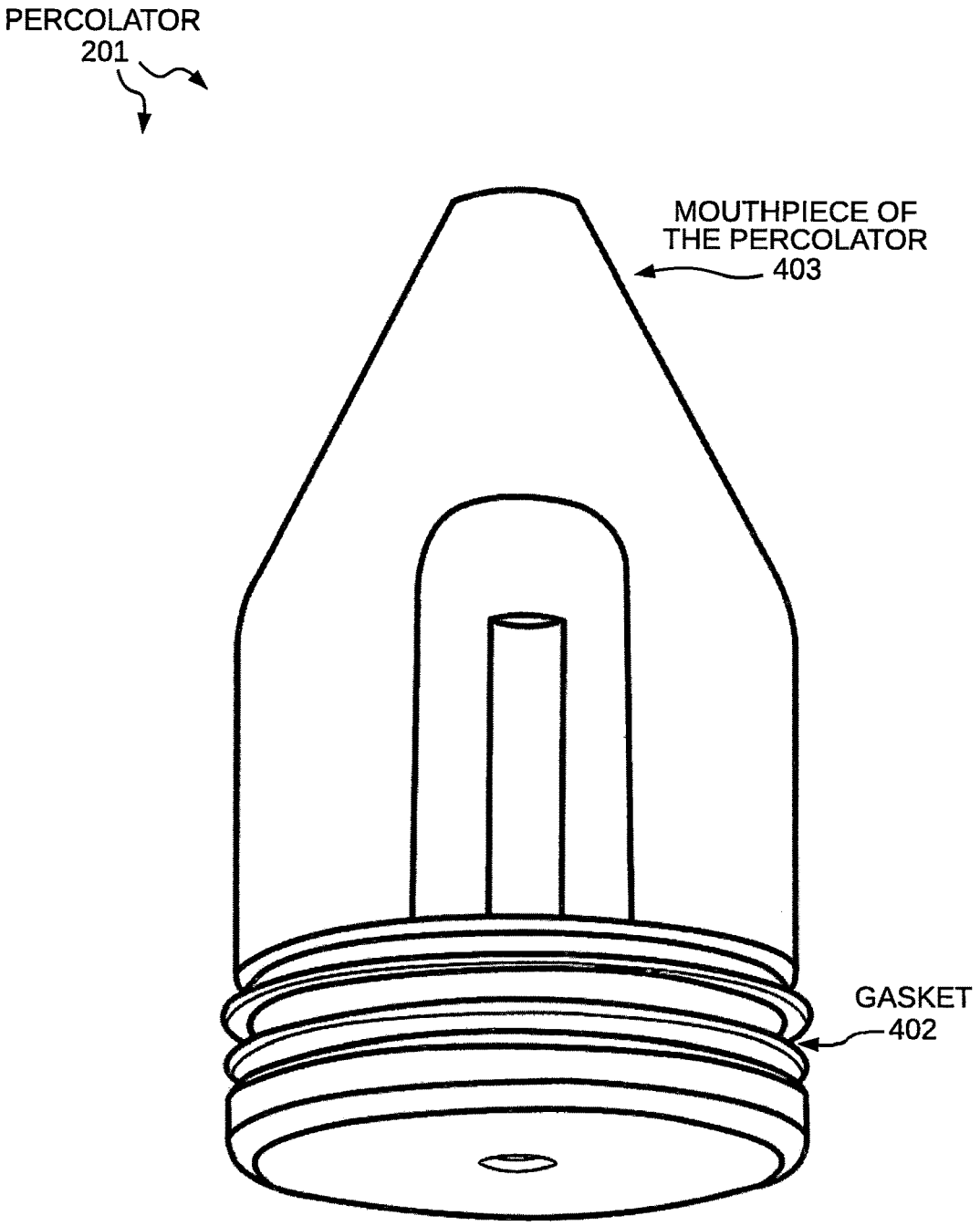
FIG. 5 illustrates a perspective view of the percolator according to one embodiment of the invention.

FIGS. 4 and 5 show a perspective view of the percolator 201. In a certain embodiment, the percolator 201 is comprised of a gasket 402 and a mouth piece 403. The mouth piece 403 is arranged at a upper portion of the percolator 201. The percolator 201 is arranged within the upper container 102 and slides along the inner cylinder wall to the upper container rim. To extract the percolator 201 and the mouth piece 403, the upper container lid 104 is detached from the upper container 102 and the inlet port cap 203 is detached from the inlet port 103, and with the friction nipple 202 fully inserted into the mouth piece 403, the upper container lid 104 is pulled upward in a vertical motion from the upper container 102 to extract the percolator 201 from a concealed position within the upper container 102. When the percolator 201 is pulled from the concealed position inside of the upper container 102 to a extracted position, the gasket 402 is pressed against the upper container rim to form a watertight seal. The watertight seal is formed by the gasket 402 being pressed against the upper container rim which prevents or limits air leaking or passing between the percolator and the inner cylinder wall of the upper container 102 when a user applies pressure (negative or positive pressure) through the mouth piece 403. The gasket 402 pressed against the upper container rim permits fluid communication from the mouth piece 403 of the percolator 201 through the bowl 602 connected to the stem 603 and the stem 603 connected to the inlet port 103. The percolator 201 is one selected from a group including but not limited to: dome, inline, circular, showerhead, honeycomb, tree, matrix, swiss, donut, turbine, or a combination thereof. The preferred percolator 201 is a dome percolator.

Figure 6:
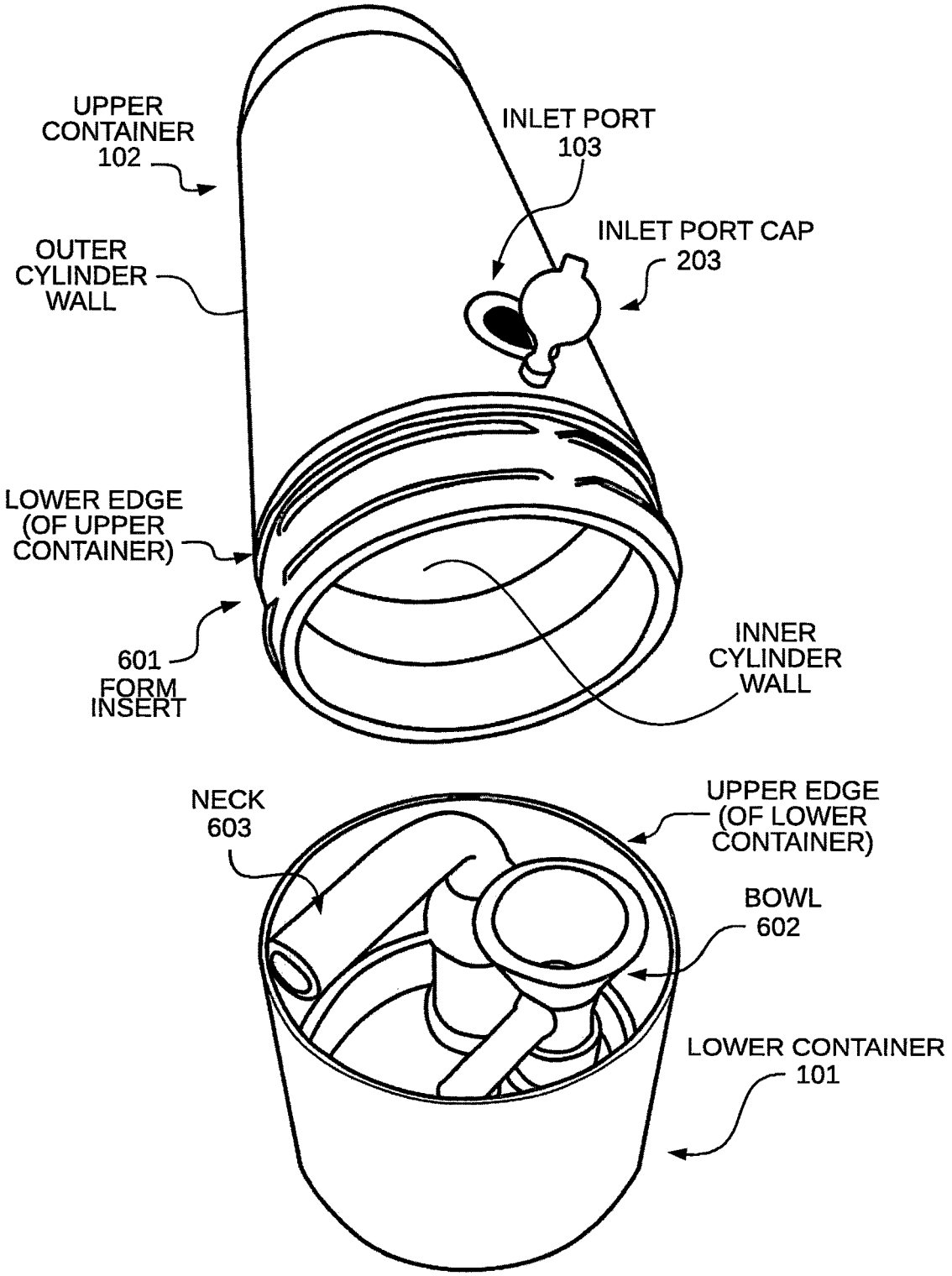
FIG. 6 illustrates a perspective view the upper container and lower container according to one embodiment of the invention.
Figure 7:
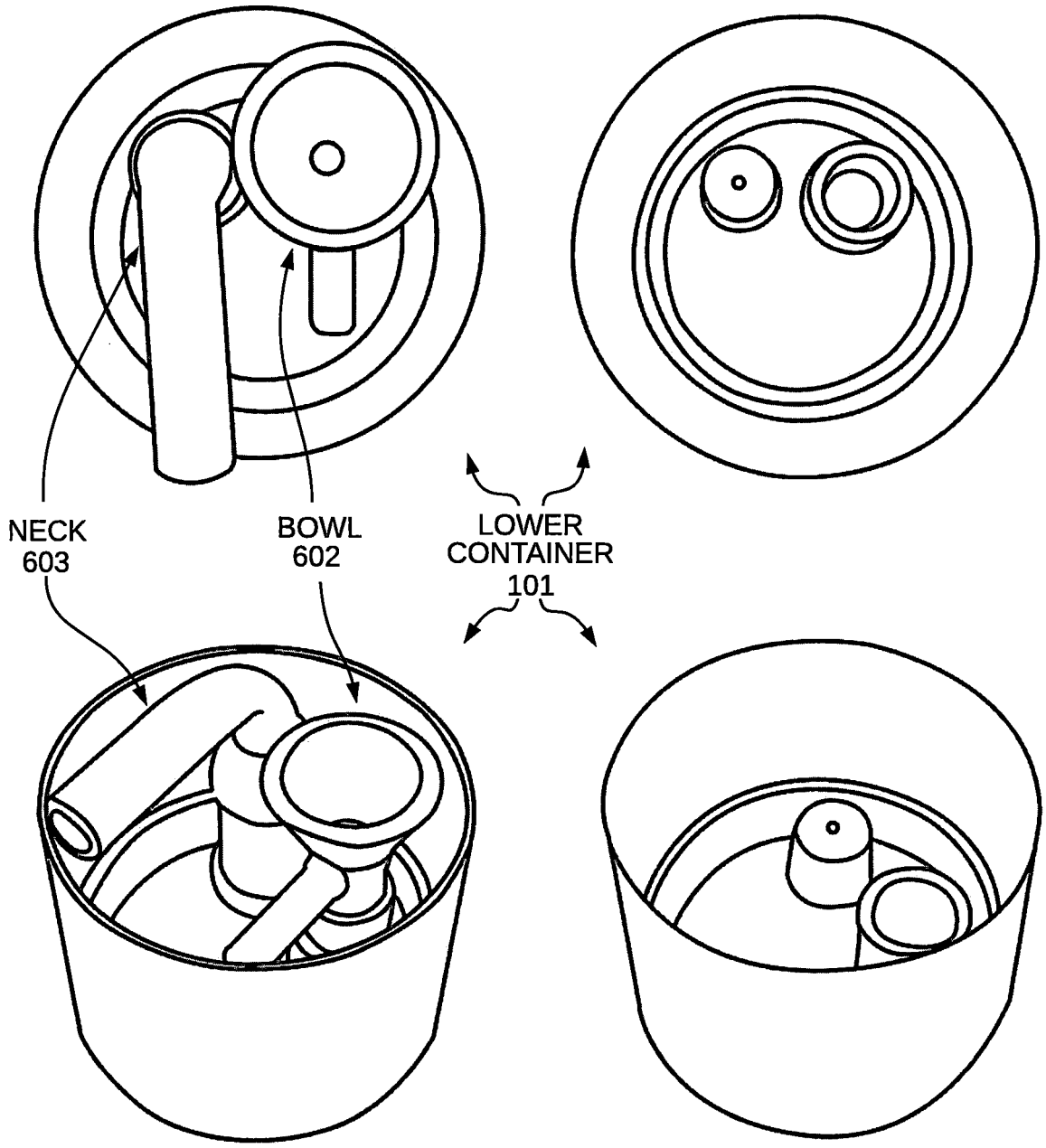
FIG. 7 illustrates a perspective view the lower container according to one embodiment of the invention.

FIGS. 6 and 7 show a perspective view the lower container 101. In an embodiment, the lower container 101 is comprised of a form insert 601 that fits the shape of the lower container 101 and is adapted to be detachably coupled to the lower edge of the upper container 102 and the lower container 101 is detachably coupled to the form insert. In another embodiment, a neck 603 and a bowl 602 can be attached to the form insert 601 to prevent the neck 603 and the bowl 602 from cracking, chipping, or breaking while stored inside the lower container 101. In an embodiment, the portion of the inside of the form insert 601 is molded to form a shape that imitates the inside of the neck 603 and the inside of the bowl 602 for the neck 603 and the bowl 602 to be attached to the portion of the inside of the form insert 601. The neck 603 and the bowl 602 are secured and mated to the portion of the inside of the form insert 601 with an interference fit, also known as a press fit or friction fit, that produces a joint which is held together by friction after the neck 603 and the bowl 602 is pressed against the portion of the inside of the form insert 601.

Figure 8:
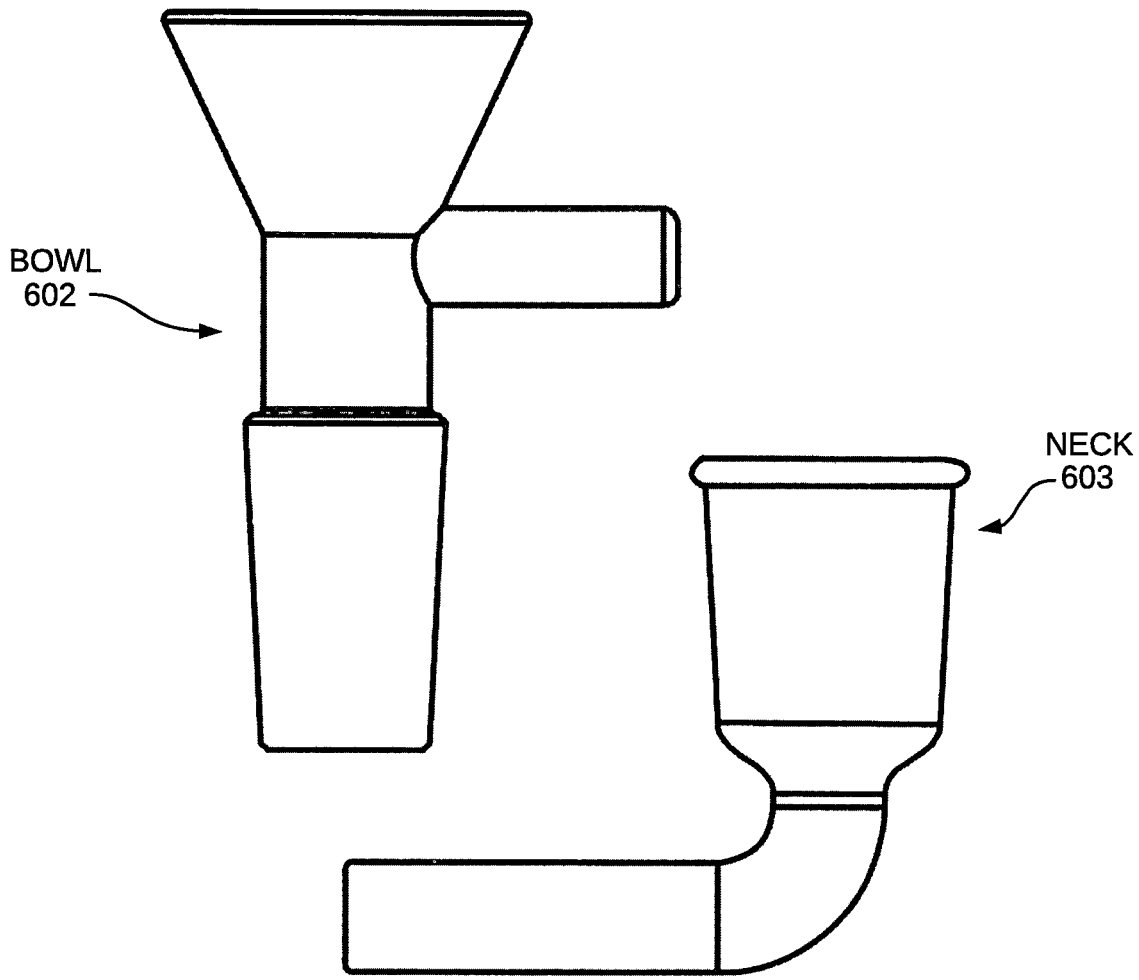
FIG. 8 illustrates a perspective view of the neck and bowl according to one embodiment of the invention.

FIG. 8 shows a perspective view of the neck 603 and the bowl 602. The neck 603 is in fluid communication with the percolator 201 when a user connects the neck 603 to a inlet port 103 extending through the outer cylinder wall and inner cylinder wall and into the upper container 102. The inlet port 103 is comprised of a inlet port cap 203 to protect the inlet port 103 and prevent the inside of the upper container 102 from getting contaminated. The neck 603 may be configured to be stored in the lower container 101. When the lower container 101 is detached from the upper container 102, a user may then access the lower container 101 to remove the neck 603. The bowl 602, when attached to the neck 603, is in fluid communication with the neck 603 and the percolator 201. The bowl 602 may be configured to be stored in the lower container 101. The neck 603 and bowl 602 are designed from a variety of materials. The preferred material of the neck 603 and bowl 602 is glass.

Figure 9:
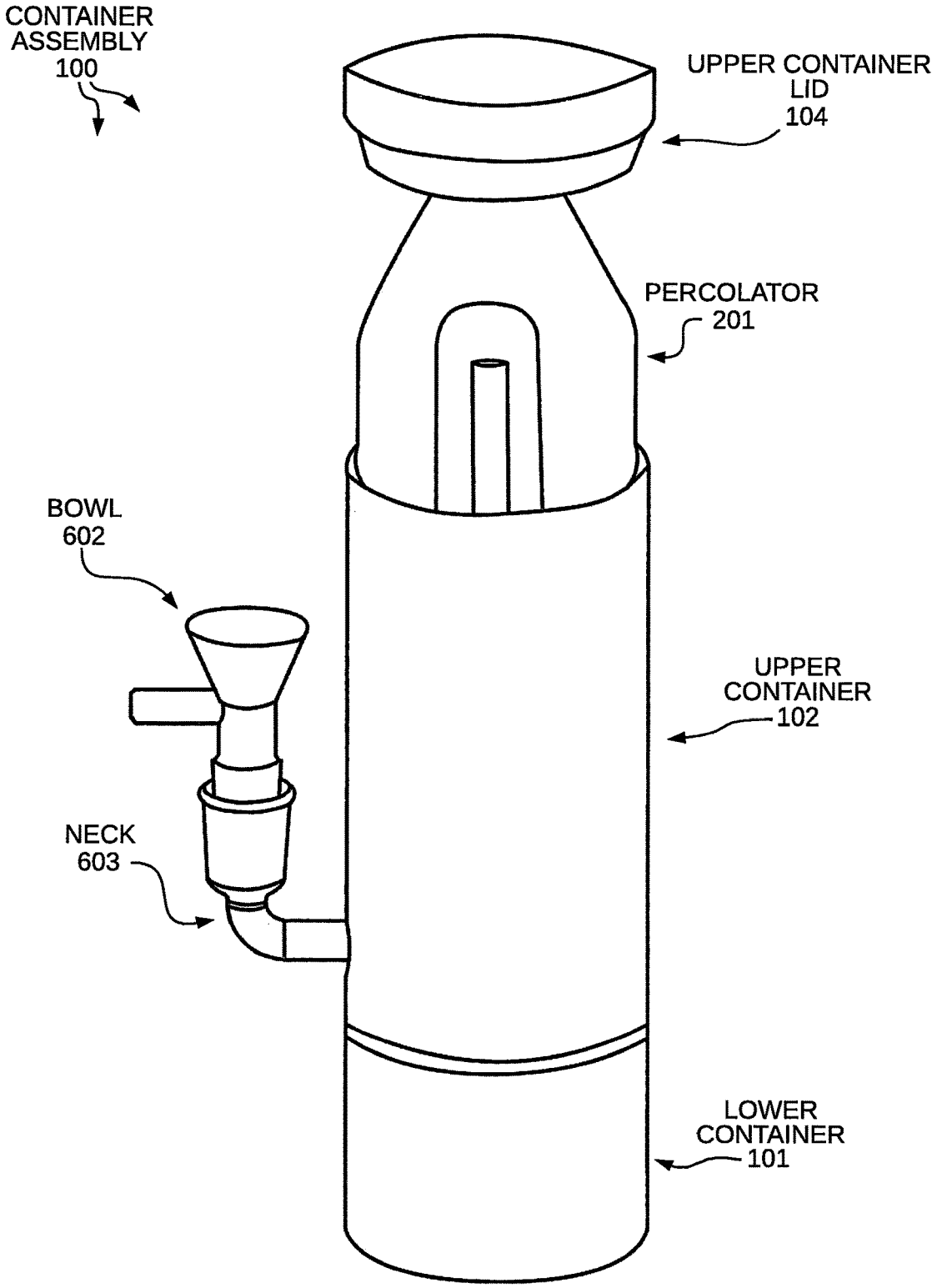
FIG. 9 illustrates a perspective view of the container assembly according to one embodiment of the invention.
Figure 10:
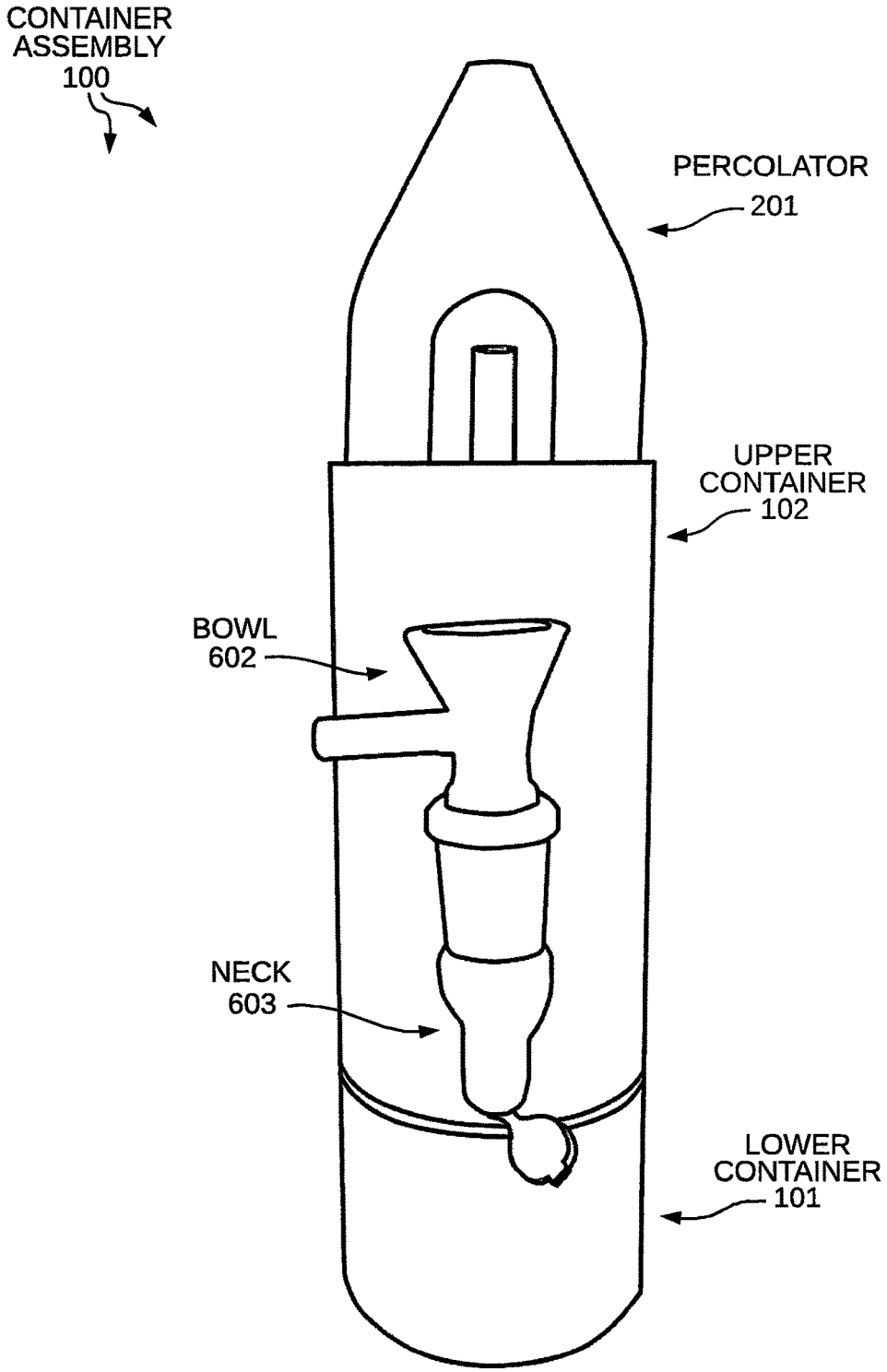
FIG. 10 illustrates a perspective view of the container assembly according to one embodiment of the invention.

FIGS. 9 and 10 show a perspective view of the container assembly 100 wherein the percolator 201 is in a extracted position, the upper container lid 104 is detached from the percolator 201, the neck 603 is attached to the inlet port 103, and the bowl 602 is attached to the neck 603. The container assembly 100 can now be used as a traditional water bong or pipe.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A container assembly configured to store a water bong; the container assembly comprising:

an upper container, wherein the upper container further comprises: an inner cylinder wall, an outer cylinder wall, an upper edge, a lower edge, an upper container rim arranged at the upper edge of the upper container, and an inlet port, and wherein the inlet port extends through the outer cylinder wall and the inner cylinder wall and into the upper container;

an upper container lid, wherein the upper container lid is detachably coupled to the upper edge of the upper container;

a lower container, wherein the lower container is detachably coupled to the lower edge of the upper container;

a percolator, wherein the percolator further comprises a gasket and a mouth piece;

a neck, wherein the neck is detachably coupled to the inlet port and is in fluid communication with the percolator through the inlet port, and wherein the neck is configured to be stored in the lower container; and a bowl, wherein the bowl is detachably coupled to the neck and is in fluid communication with the neck and the percolator, and wherein the bowl is configured to be stored in the lower container.

2. The container assembly of claim 1, wherein the percolator is arranged within the upper container and configured to slide along the inner cylinder wall to the upper container rim.

3. The container assembly of claim 2, wherein the gasket is pressed between the percolator and the upper container rim to form a watertight seal.

4. The container assembly of claim 1, wherein the mouth piece is arranged at an upper portion of the percolator.

5. The container assembly of claim 1, wherein the upper container lid is detachably coupled to the mouth piece.

6. The container assembly of claim 5, the upper container lid further comprising:

a friction nipple, wherein the friction nipple is detachably coupled to the mouth piece and is configured to be inserted into the mouth piece of the percolator.

7. The container assembly of claim 1, wherein the inlet port further comprises:

an inlet port cap.

8. A method for concealing a water bong in a container assembly, comprising:

attaching an upper container lid of the container assembly to a mouth piece arranged at an upper portion of a percolator of the container assembly;

applying pressure to the upper container lid to slide the percolator from an extracted position to a concealed position, wherein the percolator is concealed within an upper container of the container assembly;

disconnecting a bowl of the container assembly from a neck of the container assembly;

placing the bowl in a lower container of the container assembly;

disconnecting the neck from an inlet port of the upper container; and placing the neck in the lower container.

9. The method of claim 8, further comprising:

securing the upper container lid to an upper edge of the upper container; and securing the lower container to a lower edge of the upper container.

10. The method of claim 8, wherein attaching the upper container lid to the mouth piece further comprises:

inserting a friction nipple into the mouth piece of the percolator.

11. An assembly comprising:

an upper container having an inlet port;

an upper container lid, wherein the upper container lid is detachably coupled to the upper container;

a lower container, wherein the lower container is detachably coupled to the upper container;

a percolator;

a neck that is detachably coupled to the inlet port, wherein the neck is configured to be stored in the lower container; and a bowl that is detachably coupled to the neck, wherein the bowl is configured to be stored in the lower container.

12. The assembly of claim 11, wherein the upper container includes an inner cylinder wall, an outer cylinder wall, an upper edge, a lower edge, and an upper container rim arranged at the upper edge of the upper container, and wherein the inlet port extends through the outer cylinder wall and the inner cylinder wall and into the upper container.

13. The assembly of claim 11, wherein the percolator is arranged within the upper container, and wherein the percolator is configured to slide along an inner cylinder wall of the upper container to an upper container rim of the upper container.

14. The assembly of claim 11, wherein a gasket is pressed between the percolator and the upper container rim to form a watertight seal.

15. The assembly of claim 11, wherein the percolator includes a mouth piece at an upper portion of the percolator.

16. The assembly of claim 15, wherein the mouth piece is detachably coupled to the upper container lid.

17. The assembly of claim 15, wherein the upper container lid includes a friction nipple, wherein the friction nipple is detachably coupled to the mouth piece and is configured to be inserted into the mouth piece of the percolator.

18. The assembly of claim 11, wherein an inlet port cap is attachable to the inlet port.

19. The assembly of claim 11, wherein the neck is coupled to the percolator via the inlet port.

20. The assembly of claim 11, wherein the bowl is in fluid communication with the neck and the percolator.

* * * * *